US007473134B2

(12) United States Patent
Zhang

(10) Patent No.: US 7,473,134 B2
(45) Date of Patent: Jan. 6, 2009

(54) ELECTRICAL CONNECTOR

(75) Inventor: Han-Ming Zhang, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/888,791

(22) Filed: Aug. 2, 2007

(65) Prior Publication Data

US 2008/0032547 A1 Feb. 7, 2008

(51) Int. Cl.
*H01R 13/648* (2006.01)

(52) U.S. Cl. ..... 439/607

(58) Field of Classification Search ..... 439/67, 439/71, 77, 108, 607
See application file for complete search history.

(56) References Cited

U.S. PATENT DOCUMENTS 4,130,327 A * 12/1978 Spaulding ..... 439/71
4,511,201 A * 4/1985 Baker et al. ..... 439/260
5,451,165 A * 9/1995 Cearley-Cabbiness et al. ..... 439/71
7,147,481 B2 * 12/2006 Yang ..... 439/71
7,232,316 B2 * 6/2007 Chen ..... 439/71
7,255,600 B2 * 8/2007 Ma ..... 439/607
2003/0218873 A1 * 11/2003 Eromaki et al. ..... 361/816
2006/0121756 A1 * 6/2006 Kuo et al. ..... 439/76.1
2007/0238357 A1 * 10/2007 Wang ..... 439/607
2008/0032553 A1 * 2/2008 Wang ..... 439/607
2008/0045085 A1 * 2/2008 Zhang ..... 439/607
2008/0050941 A1 * 2/2008 Zhang ..... 439/67

* cited by examiner

*Primary Examiner*—Renee Luebke
*Assistant Examiner*—Larisa Tsukerman
(74) *Attorney, Agent, or Firm*—Wei Te Chung

(57) ABSTRACT

An electrical connector for connecting an electrical component to a printed circuit board through a flexible printed circuit comprises a shell defining a receiving space and a spring plate assembled in a bottom of the shell. The spring plate includes a main section extending in the longitudinal direction and against the bottom of the shell and contact sections extending from the two opposite sides of the main section. The main section defines a protrusion towards the receiving space in order to prevent the electrical component from overcompressing the spring plate.

8 Claims, 5 Drawing Sheets

ELECTRICAL CONNECTOR

BACKGROUND OF THE INVENTION

1. Field of the Invention

The present invention relates to an electrical connector, and more particularly to an electrical connector for connecting a camera module to a printed circuit board via a flexible printed circuit.

2. Description of the Related Art

An electrical connector is used in many kinds of electrical components, such as an image pickup device.

FIGS. 1 and 2 disclose a conventional electrical connector 1' for connecting an electrical component 3', such as a camera module, to a printed circuit board (not shown) via a flexible print circuit 2', comprising a shell 10' defining a receiving space 100' and a spring 11' assembled in the bottom of the shell 10'. The shell 10' includes four sidewalls 102' and a bottom wall 101' connecting said sidewalls 102', wherein the receiving space 100' is formed by the sidewalls 102' and bottom wall 101'. The spring 11' has a main portion 110' resting on the bottom of the shell 10' and a plurality of elastic arms 111' pressing against the flexible printed circuit 2'. In assembling, the spring 11', the flexible printed circuit 2', and the component 3' are put in the receiving space 100' in turn. At the same time, the spring 11' move downwardly in the action of the component 3' pressing the flexible printed circuit. The flexible printed circuit 2' get an elastic force coming from the spring 11' and, therefore, a steady electrical connection is provided between the component 3' and the flexible printed circuit 2'.

However, when the component is put into the receiving space, the component will produce an excess force on the spring via the flexible printed circuit. Therefore, the spring might be pressed overly such that the spring force produced by the spring on the flat printed circuit will be reduced.

Therefore, an improved electrical connector is desired to overcome the above problems.

BRIEF SUMMARY OF THE INVENTION

It is an object of the present invention to provide an electrical connector in order to offer a steady electrical connection between the component and the flexible printed circuit.

In order to obtain the objective above, an electrical connector in accordance with a preferred embodiment of the present invention comprises a shell defining a receiving space upwardly and a spring plate assembled on the bottom of the shell. The spring plate includes a main portion against the bottom of the shell and extending in the longitudinal direction and a plurality of elastic arms extending outward from the opposite side of the main section. And at least one protrusion is formed on the top surface of the main section. In assembling the electrical connector, the component moves downwardly till it touches with the protrusion of the spring plate. Accordingly, the elasticity of the spring plate is improved and the component cannot overly compress the spring plate.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
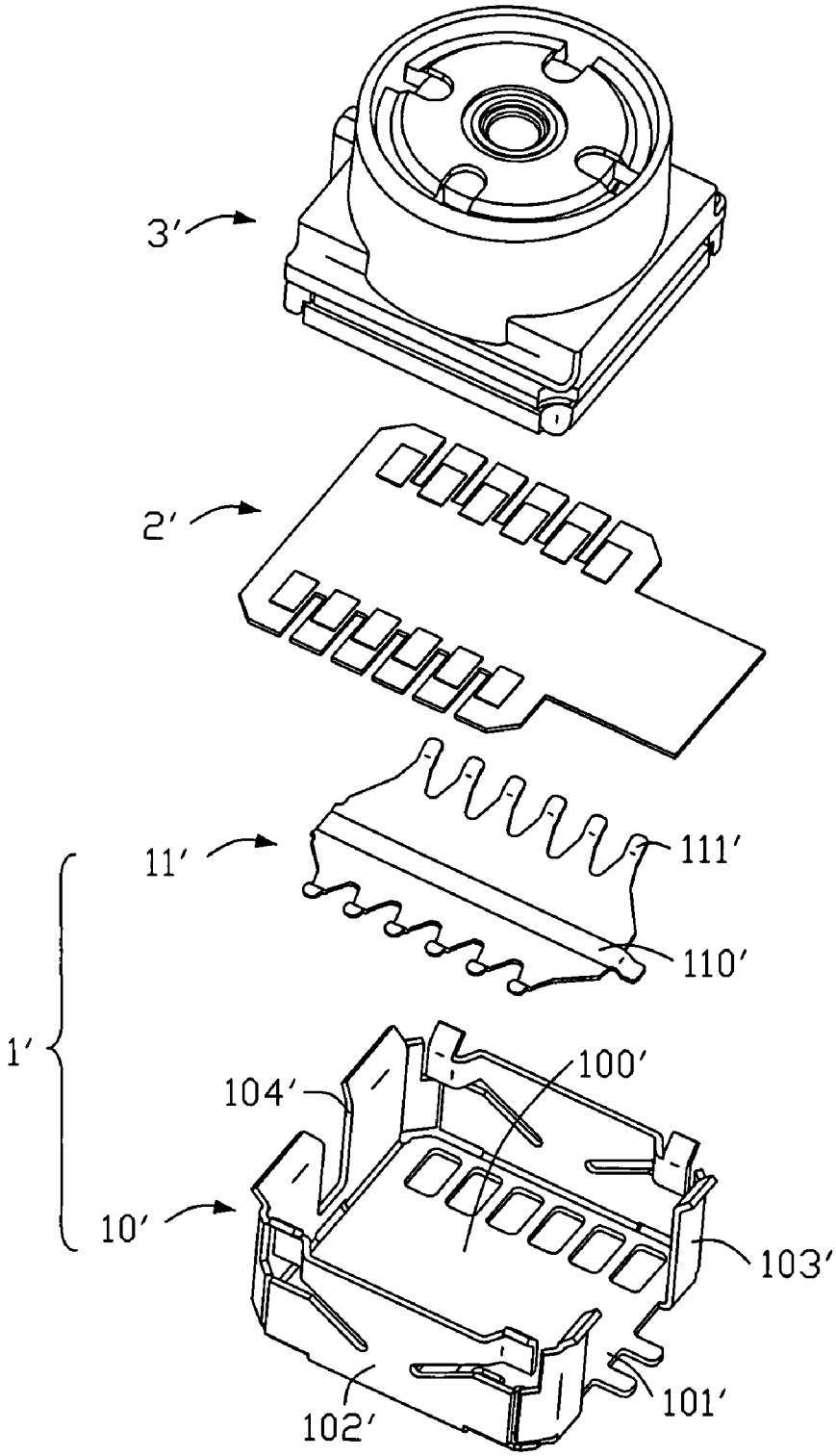
FIG. 1 (PRIOR ART)
FIG. 1 is an exploded view of an electrical connector of the prior art.
Figure 2:
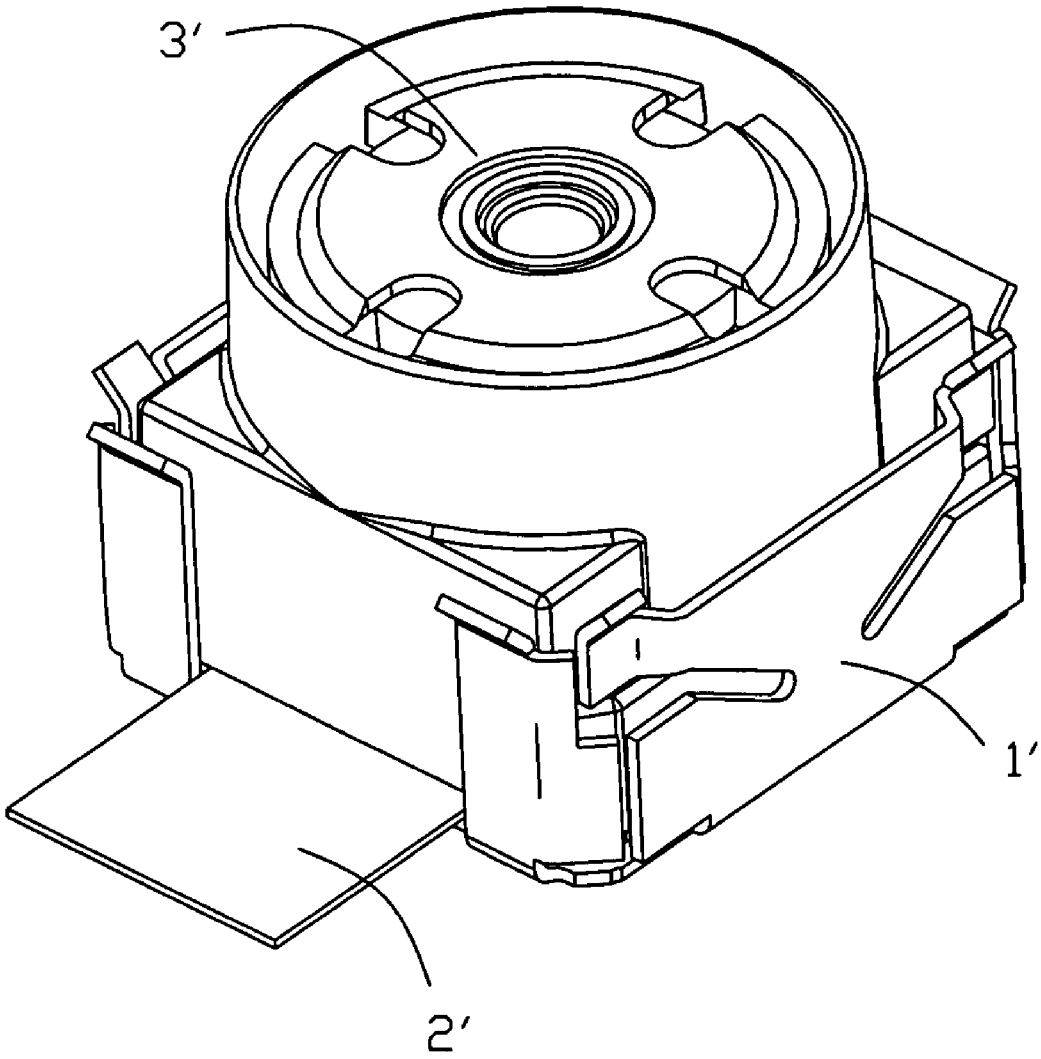
FIG. 2 (PRIOR ART)
FIG. 2 is a perspective view of an electrical connector of the prior art.

In the following detailed description, for purposes of explanation, numerous specific details are set forth in order to provide a thorough understanding of the present invention. It will be apparent, however, that the present invention may be practiced without these specific details. In other instances, well-known structures and devices are schematically shown in order to simplify the drawing.

An electrical connector according to the present invention is applicable to electronic apparatuses such as digital cameras, PDAs (Personal Digital Assistants), PCs (Personal Computers), mobile phones or the like. In the preferred embodiment illustrated in FIGS. 1-5, the electrical connector 1 is used in a mobile handset (not shown) for connecting a camera module 3 to an internal PCB (not shown) via a flexible printed circuit 2.

Figure 3:
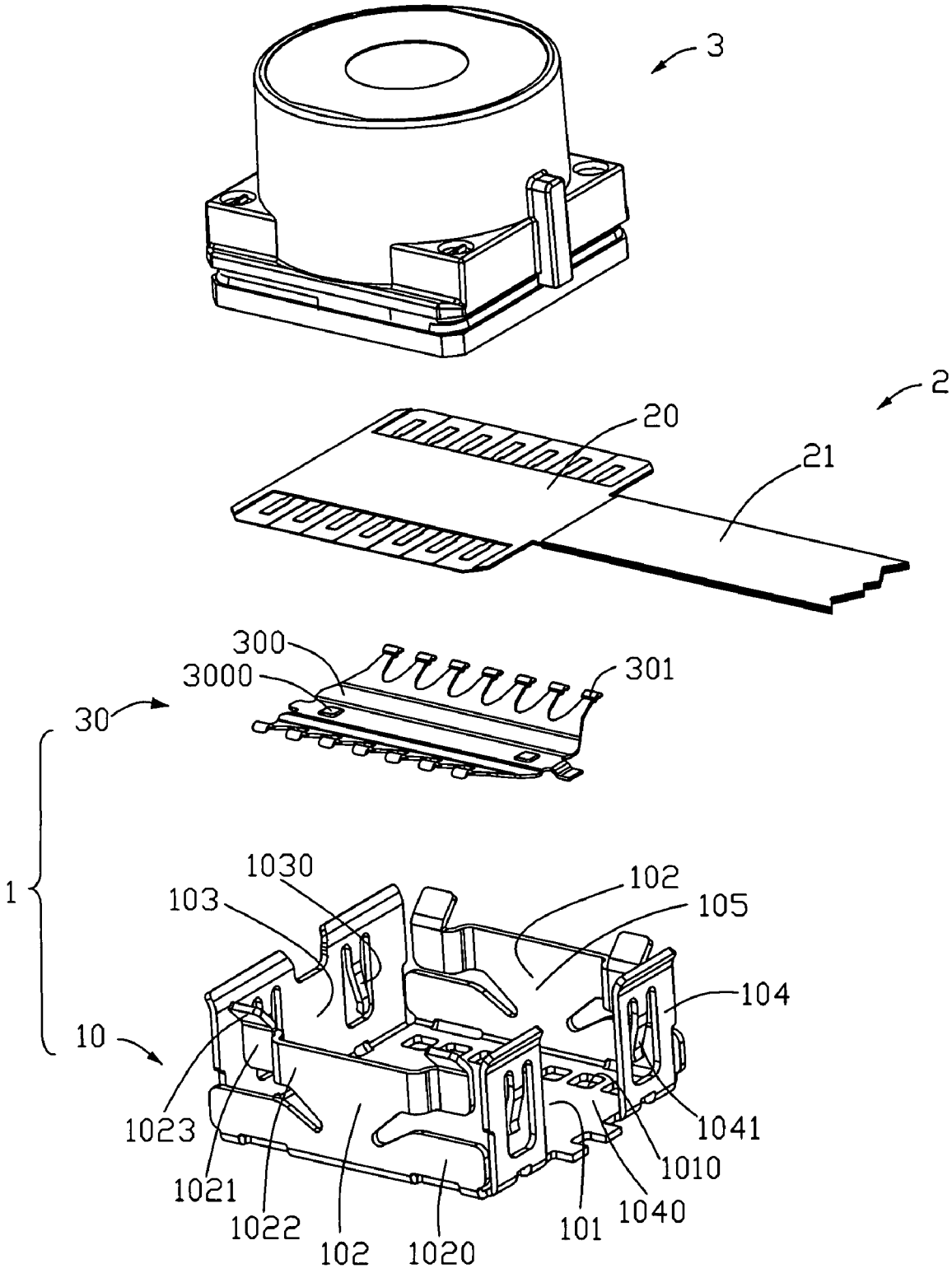
FIG. 3 is an exploded view of an electrical connector of the present invention.

FIG. 3 is an exploded perspective view of the electrical connector for receiving a camera module in the embodiment of this invention. In the figure, the reference numeral 10 denotes a shell made of a metal material. The reference numeral 30 denotes a spring plate made of metal sheet and assembled on the bottom of the shell 10.

The shell 10 is made of metal material and is a configuration of a frame. The shell 10 defining a cavity 100 upwardly open includes a pair of opposite rear and front walls 102, a pair of left and right walls 103, 104 adjacent to the rear and front walls 102, and a flat bottom wall 101 connecting the walls 102, 103, 104. The walls 102, 103, 104 and the bottom wall 101 together enclose a cavity 100 as a receiving section to receive the camera module 3 therein.

A window 1040 is provided on the right wall 104 for passing through by the flexible printed circuit 2. A plurality of retaining spring pieces 1041, 1030 are formed on the left and right walls 104, 103, respectively, and extend inward to the cavity 100 to contact with the camera module 3. The front and rear wall 102 each include an upright base 1020 extending upwardly from the bottom wall 101, a retaining section 1021 extending from each of the two side ends of the sidewall 102 toward the cavity 100, and a connecting section 1022 formed a V configuration joining said base 1020 and retaining section 1021. The end of the retaining section 1021 defines a chamfer 1023 outward the cavity 100 in order to lead the camera module 3 to the shell 10.

As shown in FIG. 3, the spring plate 30 is formed from a metal sheet and mounted on the bottom of the shell 101. Said spring plate 30 is in a configuration of fishbone and comprises a main portion 300 extending along the longitudinal direction and against the bottom of the shell 101 and a plurality of elastic arms 301 extending outward from the opposite sides of the main portion 300. A plurality of openings 1010 is formed on the bottom of the shell 101 corresponding with the elastic arms 301. When pressing the spring plate 30, the elastic arms 301 undergo an elastic displacement and may run into the openings 1010 provided for increasing the active space of the spring plate 30. At least one protrusion 3000 is formed on the top surface of the main portion 300 for contacting with the flexible printed circuit 2 and stopping the camera module 3 from further moving downwardly.

The flexible printed circuit 2 between the camera module 3 and the spring plate 30 comprises a first section 20 received in the cavity 100 of the shell 10 and a second section 21 extending outward from the window 1040 of the shell. The top surface of the first section 20 defines a plurality of conductive elements so as to contact with the camera module 3 for electrical connecting the camera module 3 to the printed circuit board (not shown).

Figure 4:
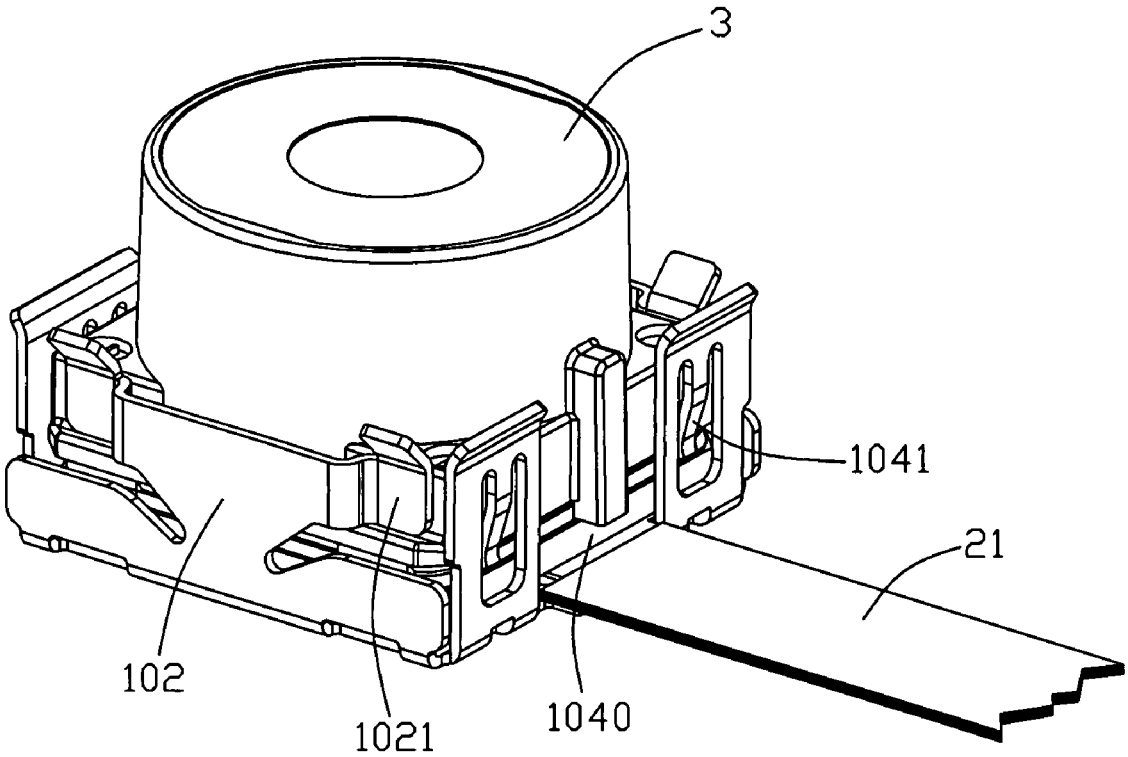
FIG. 4 is a perspective view of an electrical connector of the present invention.
Figure 5:
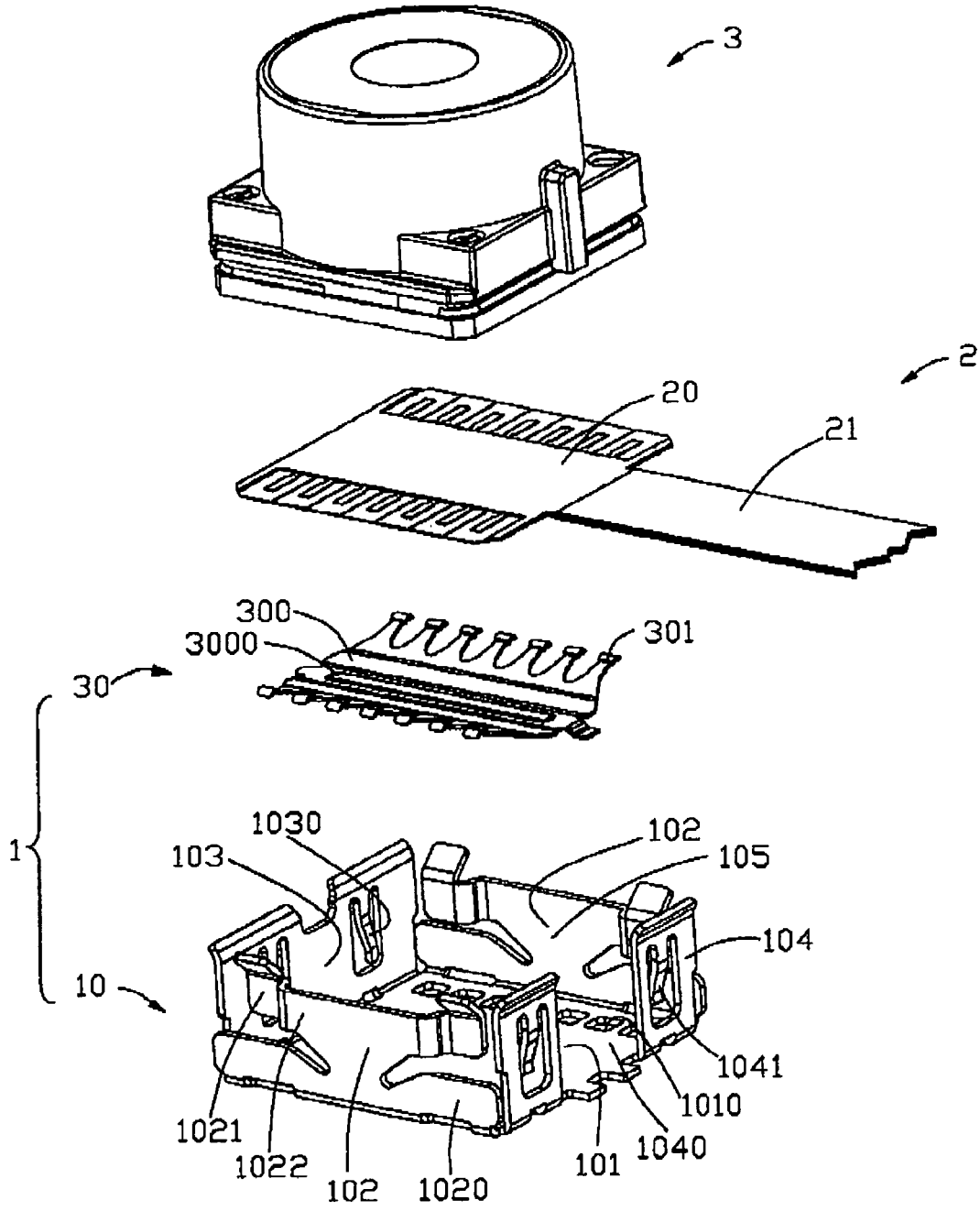
FIG. 5 is an exploded view of another embodiment of present invention.

Referring to FIGS. 3 and 4, in assembling the electrical connector 1, the spring plate 30, the flexible printed circuit 2, and the camera module 3 are received in the cavity 100 in turn. And the retaining section 1021 of the front and rear wall 102 of the shell 10 and the retaining spring pieces 1030, 1041 of the left and right walls 103, 104 may deform in the action of the camera module 3 and the shell 10 can retain the camera module 3 through the elastic force. The first section 20 of the flexible printed circuit 2 is received in the cavity 100 of the shell 10 and the top and the bottom surfaces of the first section 20 are contacted with the bottom of the camera module 3 and the elastic arms 301 of the spring plate, and the second section 21 of the flexible printed circuit 2 extends outward of the shell 10 via the window 1040. When assembling the camera module 3 to the shell 10, at the beginning, the bottom of the camera module 3 exerts a force on the elastic arms 301 via the flexible printed circuit 2, and the elastic arms 301 can deform elastically because of the camera module 3 moving downwardly until stopped by the protrusions 3000 of the spring plate 30. Accordingly, the camera module 3 does not overly press the elastic arms 301 because of the protrusions 3000.

In the detailed description of this invention, the protrusions 3000 are located near two ends of the spring plate 30 in the longitudinal direction and spaced from each other. However, the protrusions 3000 may run through the main portion 300 of the spring plate 30 and form a continuous strip. Alternatively, only a single protrusion may be provided.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector adapted for connecting a camera module to a printed circuit board via a flexible printed circuit, comprising:

a shell including a bottom wall and a plurality of side walls commonly defining a receive space for receiving the camera module therein; and a spring plate received in the shell, the spring plate comprising a main portion extending along a longitudinal direction thereof and a plurality of elastic arms extending outward from two opposite sides of the main portion, wherein the main portion has a bottom surface resting against the bottom wall of the shell and a top surface opposite to the bottom surface, a protruding portion being formed on the main portion of the spring plate above the top surface thereof and protruding in the same upward direction as the elastic arm.

2. The electrical connector according to claim 1, wherein the protruding portion includes two protrusions spaced from each other.

3. The electrical connector according to claim 1, wherein the protruding portion comprises a continuous strip running through the main portion of the spring plate.

4. The electrical connector according to claim 1, wherein the bottom wall of the shell defines a plurality of openings corresponding to the elastic arms of the spring plate.

5. The electrical connector according to claim 1, wherein the elastic arms are symmetrically arranged on the two opposite sides of the main portion.

6. The electrical connector according to claim 1, wherein the spring plate is adapted for urging the flexible printed circuit against the module.

7. The electrical connector according to claim 6, wherein window is formed on one of the sidewalls for providing a path for the flexible printed circuit passing through.

8. An electrical connector assembly comprising:

a shell defining an upward cavity;

a module downwardly received in the cavity; and a spring plate received in the shell, the spring plate comprising a main portion resting against a bottom wall of the shell, and a plurality of elastic arms extending laterally from two opposite sides of the main portion; wherein said module are mechanically and electrically engaged with said elastic arms at a level which is guaranteed to be constantly higher than the main portion, thus assuring no over-deflection of said elastic arms, wherein the module is seated upon a protrusion which is raised upwardly from a top surface of the main portion in the same upward direction as the elastic arms, and the protrusion functions as a stopper for the module to prevent further downward movement of the camera in the cavity so as to guarantee the no over-deflection of the elastic arms.

* * * * *